US007658662B2

(12) United States Patent
Tremblay et al.

(10) Patent No.: US 7,658,662 B2
(45) Date of Patent: Feb. 9, 2010

(54) AUTOMATIC LOCKING SYSTEM FOR DUMPING TOY

(75) Inventors: Daniel Tremblay, Montreal (CA); Stephane Cyr, Bois des Filion (CA); Richard Martin, St-Constant (CA)

(73) Assignee: Mega Brands Inc., Montreal, Quebec (CA)

( * ) Notice: Subject to any disclaimer, the term of this patent is extended or adjusted under 35 U.S.C. 154(b) by 356 days.

(21) Appl. No.: 11/655,236

(22) Filed: Jan. 19, 2007

(65) Prior Publication Data

US 2007/0224911 A1 Sep. 27, 2007

Related U.S. Application Data

(60) Provisional application No. 60/760,398, filed on Jan. 20, 2006.

(51) Int. Cl.
*A63H 17/06* (2006.01)

(52) U.S. Cl. ..... 446/428

(58) Field of Classification Search ..... 446/428, 446/470, 424

See application file for complete search history.

(56) References Cited

U.S. PATENT DOCUMENTS

| | | | | |
|---|---|---|---|---|
| 519,455 | A * | 5/1894 | Klees | 298/14 |
| 1,224,935 | A * | 5/1917 | Kingsbury | 446/428 |
| 1,586,624 | A | 6/1926 | Herrick | |
| 1,972,376 | A * | 9/1934 | Decker | 446/428 |
| 3,711,990 | A * | 1/1973 | Pfeilsticker | 446/428 |
| 3,931,693 | A | 1/1976 | Alexander | |
| D289,308 | S | 4/1987 | Lerch | |
| 4,846,754 | A * | 7/1989 | Peterson | 446/428 |
| 5,383,808 | A | 1/1995 | DuBois | |
| 5,538,267 | A | 7/1996 | Pasin et al. | |
| 5,676,585 | A * | 10/1997 | Nuermberger et al. | 446/428 |
| 5,727,983 | A | 3/1998 | Koldste | |
| D455,463 | S | 4/2002 | Martin et al. | |
| 7,387,558 | B2 * | 6/2008 | Swisher et al. | 446/427 |

FOREIGN PATENT DOCUMENTS

| | | | |
|---|---|---|---|
| CA | 935644 | A | 10/1973 |
| CA | 939903 | A | 1/1974 |
| CA | 2131661 | A1 | 8/1995 |
| WO | WO 97/02879 | A | 1/1997 |

OTHER PUBLICATIONS

International Preliminary Report on Patentability (Chapter I of PCT) dated Jul. 31, 2008.
International Search Report and Written Opinion of International Searching Authority dated Jun. 26, 2007.

* cited by examiner

*Primary Examiner*—Gene Kim
*Assistant Examiner*—Matthew B Stanczak
(74) *Attorney, Agent, or Firm*—Plumsea Law Group, LLC

(57) ABSTRACT

A toy having a pivoting member such as a dump bucket or bed, with an automatic locking system on the pivoting member. An embodiment of the present invention provides toy having a chassis, a pivoting member pivotably and slideably mounted on the chassis, and a latch mechanism. The pivoting member pivots with respect to a pivot axis and slides in a direction radial to the pivot axis from a first position to a second position. The latch mechanism engages the chassis with the pivoting member in the first position and prevents the pivoting member from pivoting, and disengages the chassis from the pivoting member in the second position to allow the pivoting member to pivot.

19 Claims, 10 Drawing Sheets

AUTOMATIC LOCKING SYSTEM FOR DUMPING TOY

This application claims the benefit of U.S. Provisional Application No. 60/760,398, filed Jan. 20, 2006, which is herein incorporated by reference in its entirety.

BACKGROUND

1. Field of the Invention

The present invention is related to toys and more particularly, to a toy vehicle having a dumping bucket or bed, such as a dump truck or toy wagon.

2. Background

Toy wagons and dump trucks are well known. FIG. 1 shows a wagon 100 that includes a base or chassis 110, wheels 115, a handle 120 at the front of the wagon 100, and a bucket 125. In a typical implementation, the dimensions of the wagon 100 are 19" in length, 12" in width, and 12¾" in height. At this size, children tend to lean on the wagon bucket 125 while playing with the wagon 100, as shown in FIG. 2*a*.

When the child rests on the rear side of bucket 125, it may pivot upward. More specifically, the wheeled base 110 can roll away from the child, causing the child to apply a downward force to the rear side of bucket 125, which then pivots the bucket upward, causing the bucket to dump its contents.

As further shown in FIG. 2*b*, when the handle 120 is stowed on top of the bucket 125 and the wagon 100 is handled by bucket 125 (rather than handle 120), bucket 125 may pivot upward and push against the handle 120, causing the handle 120 to unfold away from base 110. The toy then occupies a larger area and, if swung around, could come into contact with other objects.

There is, accordingly, a need to better control the circumstances under which the bucket 125 of wagon 100 can be pivoted upward and unfolded.

BRIEF SUMMARY OF THE INVENTION

The present invention provides a toy having a pivoting member such as a dump bucket or bed, with an automatic locking system on the pivoting member. An embodiment of the present invention provides a toy having a chassis, a pivoting member pivotably and slideably mounted on the chassis, and a latch mechanism. The pivoting member pivots with respect to a pivot axis and slides in a direction radial to the pivot axis from a first position to a second position. The latch mechanism engages the chassis with the pivoting member in the first position and prevents the pivoting member from pivoting, and disengages the chassis from the pivoting member in the second position to allow the pivoting member to pivot.

DESCRIPTION OF THE INVENTION

To control the unfolding of a dumping toy, an embodiment of the present invention provides an automatic locking system, and in particular, one that may be manipulated by a very young child. The locking system comprises a unique pivot mechanism in combination with a latch mechanism that keeps the bucket or bed of the dumping toy from pivoting.

Figure 3A:
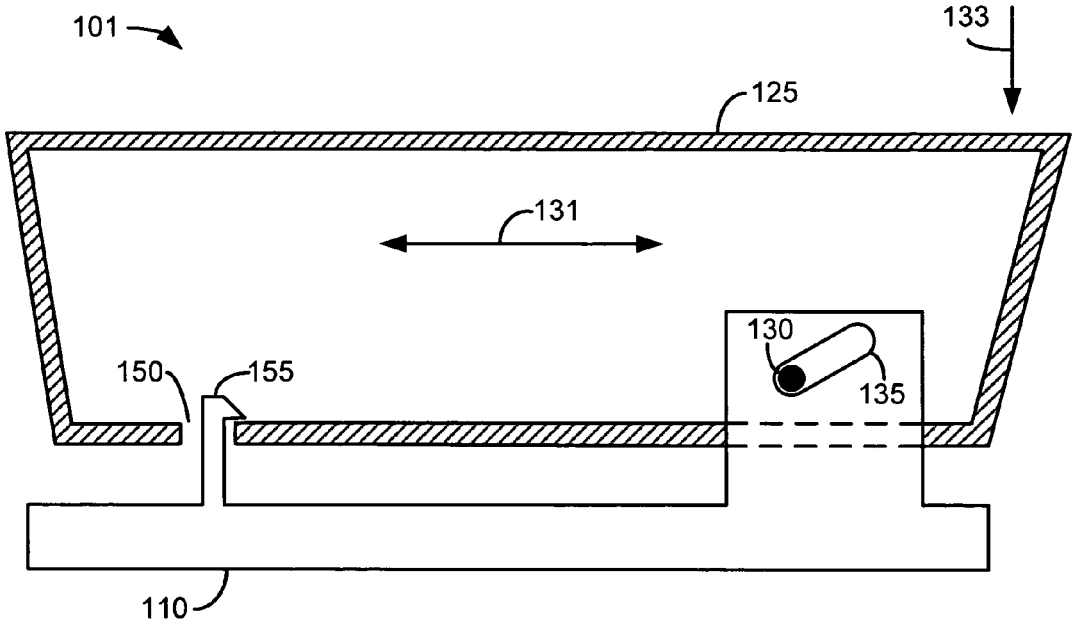
FIGS. 3*a*-3*c* are schematic diagrams of an exemplary automatic bucket locking system, shown in an engaged position, an intermediate position, and a disengaged position, respectively, according to an embodiment of the present invention.

FIG. 3*a* illustrates a wagon 101 having an automatic bucket locking system, according to an embodiment of the present invention. As shown, wagon 101 includes a bucket 125 pivotably mounted on a chassis 110 (which can include wheels—not shown). To provide this pivotal mount, bucket 125 includes at least one pivot pin 130, which slideably and pivotably engages an oblong hole or slot 135 defined in the chassis 110. The pivotal mount enables the bucket 125 to both pivot around pivot pin 130 and also move in a direction radial to the pivot pin 130, e.g., in rearward and forward directions longitudinal to the wagon 101, as represented by arrow 131 in FIG. 3*a*. For illustration purposes, in FIG. 3*a*, the forward portion of wagon 101 is on the left and the rearward portion is on the right.

In addition to the pivotal mount, wagon 101 also includes a latch mechanism that is engaged when the bucket 125 is in its most forward position with respect to chassis 110 and is disengaged when the bucket 125 is in its most rearward position with respect to chassis 110. When latch mechanism is engaged, it prevents bucket 125 from pivoting with respect to pivot pin 130.

In the example of FIG. 3*a*, the latch mechanism includes a latch 155 integral to chassis 110 and a latch receiver 150 integral to bucket 125. As shown, latch 155 can include a triangular projection that engages or snaps over latch receiver 150, which in this example is a simple opening in bucket 125. Alternatively, latch receiver 150 could be a latch plate attached to bucket 125, an example of which is described below.

FIG. 3*a* illustrates the latch mechanism in an engaged position, with the latch 155 engaging the latch receiver 150 and the bucket 125 in its most forward position. Slot 130 is preferably angled downward toward the forward portion of wagon 101 so that the bucket 125 is biased to naturally rest in its most forward slideable position. In this position, the pivot pin 130 of bucket 125 is in the forward portion of slot 135 and the latch 155 is engaged with the latch receiver 150. A force applied to bucket 125 generally in a direction represented by arrow 133—which would typically be applied by a small child leaning on the bucket 125—would further force bucket 125 forward and keep latch 155 pressed against latch receiver 150, thereby preventing bucket 125 from pivoting around pivot pin 130.

Figure 3B:
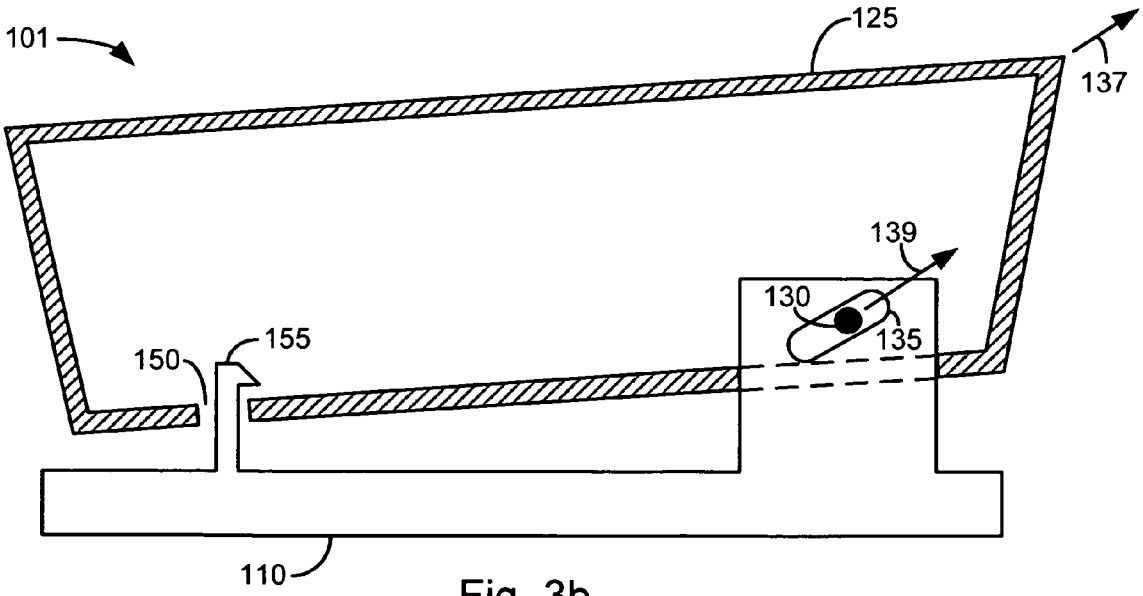
Figure 3C:
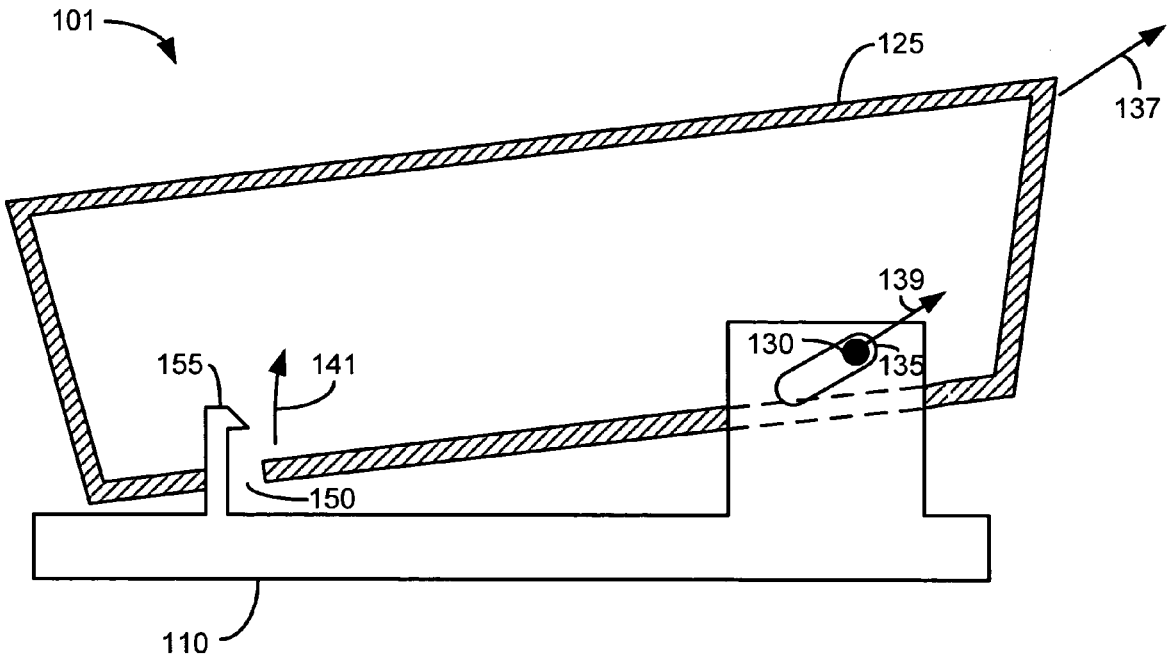

FIGS. 3*b* and 3*c* illustrate how the latch mechanism is disengaged to allow the bucket 125 to pivot. As shown in FIG. 3*b*, to separate latch 155 from latch receiver 150, the bucket 150 is moved generally in a rearward direction, as represented by arrow 137. This force causes bucket 125 to move rearward and upward, guided by pivot pin 130 sliding in slot 135, as represented by arrow 139. As shown, the forward portion of bucket 125 tilts downward while the rearward portion rises. Bucket 125 continues to move in this direction and orientation as the pivot pin 130 slides within slot 135, until pivot pin 130 reaches the rearward end of slot 135. In this most rearward position, as shown in FIG. 3*c*, latch 155 clears latch receiver 150, enabling bucket 125 to pivot upward, as represented by arrow 141. At this rearward position, the bucket 125 can be pivoted by, for example, pushing down on the rearward portion of bucket 125 or by pulling the forward portion of bucket 125 upward—maneuvers that are conveniently handled by even the youngest of users.

Figure 4A:
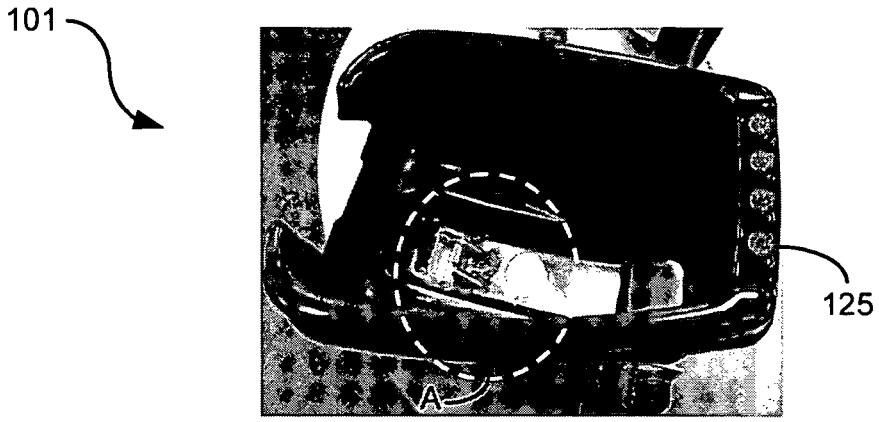
FIG. 4*a* is a schematic diagram of a top perspective view of another exemplary automatic bucket locking system, according to an embodiment of the present invention.
Figure 4B:
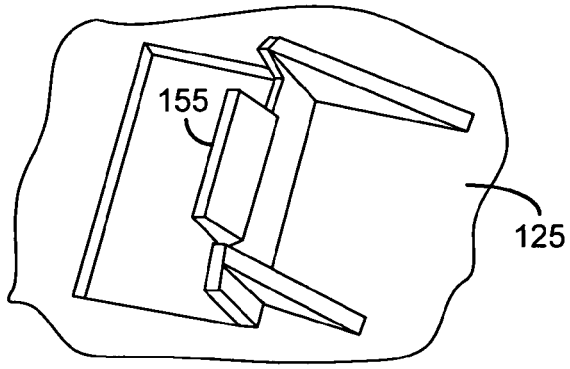
FIG. 4*b* is a schematic diagram of an enlarged view of the latch mechanism of FIG. 4*a*, in an engaged position, corresponding generally to area A of FIG. 4*a*, according to an embodiment of the present invention.
Figure 4C:
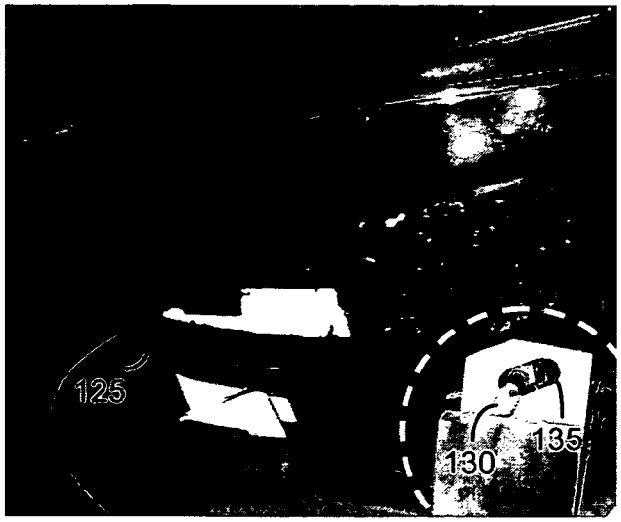
FIG. 4*c* is a schematic diagram of a side view of the locking system of FIG. 4*a*, in an engaged position.
Figure 4D:
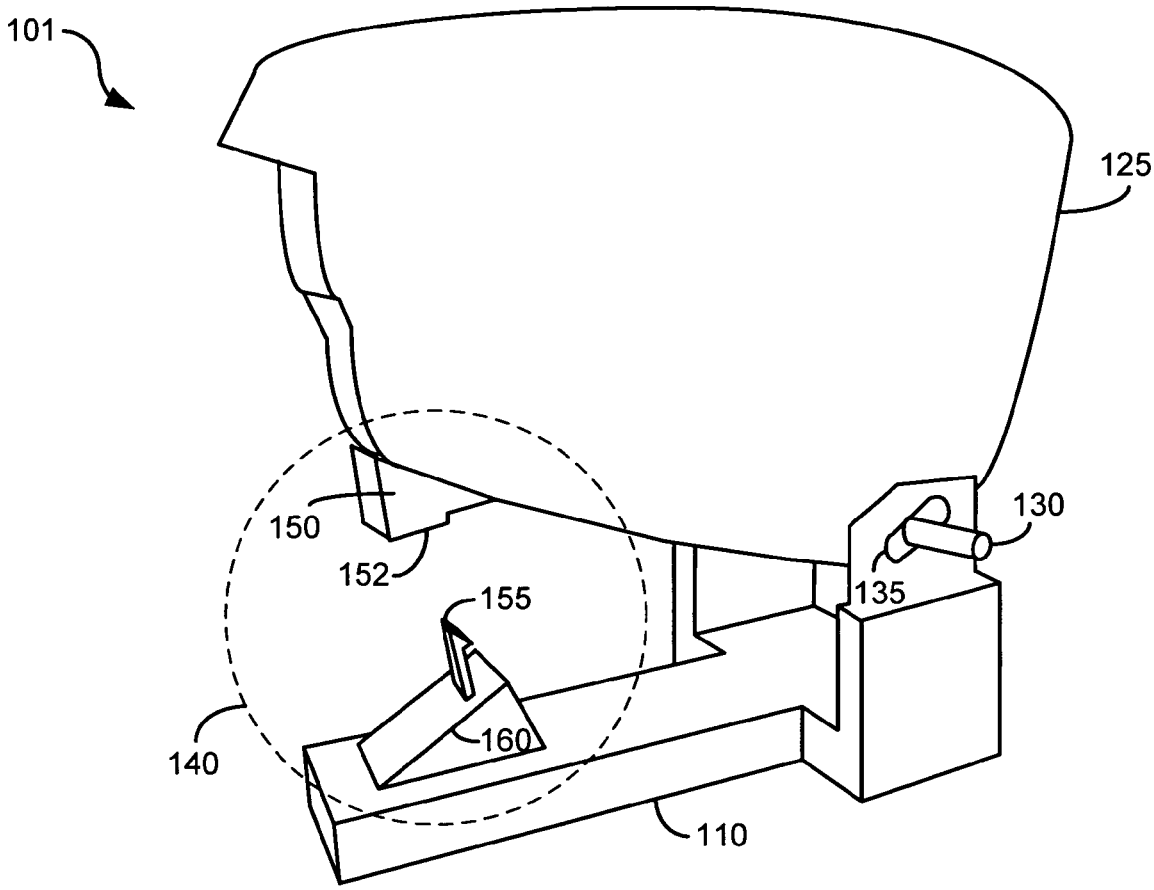
FIG. 4*d* is a schematic diagram of a side perspective view of the locking system of FIG. 4*a*, in a disengaged position.

FIGS. 4*a-g* illustrate another embodiment of the present invention, which provides a wagon 101 having a pivot pin 130 for a bucket 125 mounted in an inclined, oblong slot 135. As shown, slot 135 is integrated with chassis 110. Due to the slanting or inclination angle of slot 135, pivot pin 130 (and bucket 125 to which it is connected) is biased to slide forward and downward in an unloaded state (e.g., without any objects in the bucket and without any external forces being applied to the bucket). This natural movement causes a receiving portion 152 of a latch plate 150 that is located under bucket 125 to engage a latch 155 mounted on the bucket 125. Latch plate 150 is integrated with chassis 110. FIG. 4*d*, in particular, illustrates the latch mechanism 140.

Latch 155 is preferably mounted to a slanted plane 160 that has a slope that is substantially the same as the inclination angle of slot 135, e.g., about 30 degrees with respect to a horizontal surface on which wagon 100 rests.

Consequently, as bucket 125 is rotated into its closed position (on top of chassis 110), receiving portion 152 will immediately capture/engage latch 155 or, alternatively, a bottom surface of latch plate 150 will contact slanted plane 160 and slide downward thereon such that latch 155 will engage with receiving portion 152.

Figure 1:
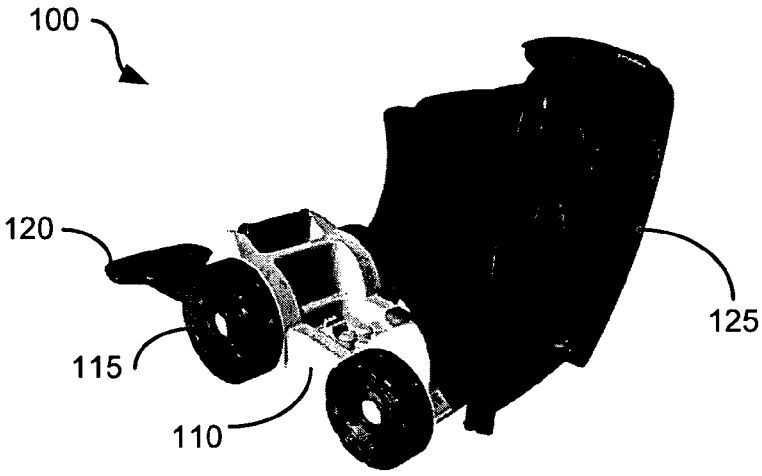
Fig. 1 [PRIOR ART]
FIG. 1 is a schematic diagram of a conventional wagon with a dumping bucket.
Figure 2A:
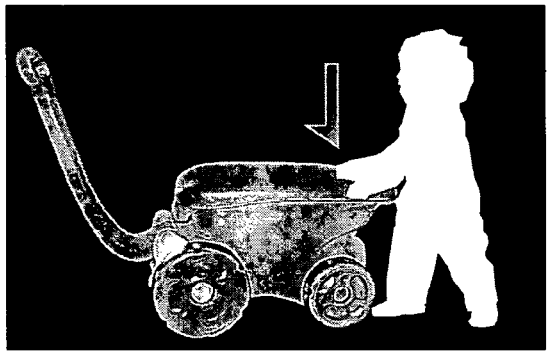
FIG. 2*a* is a schematic diagram showing a force frequently applied to a toy wagon during use.
Figure 2B:
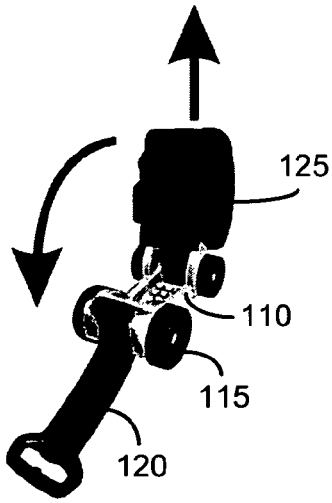
FIG. 2*b* is a schematic diagram of a toy wagon with its bucket and handle unfolded.

With the slot 135 and latch mechanism 140 implemented as described herein, even when a child leans on the back of bucket 125 as shown in FIG. 2*a*, bucket 125 will not open because the downward force on bucket 125 by the child will force pivot pin 130 downward in oblong hole 135, which causes receiving portion 152 to push against latch 155, thereby preventing bucket 125 from opening. FIGS. 4*a-c* show this engaged position.

Figure 4E:
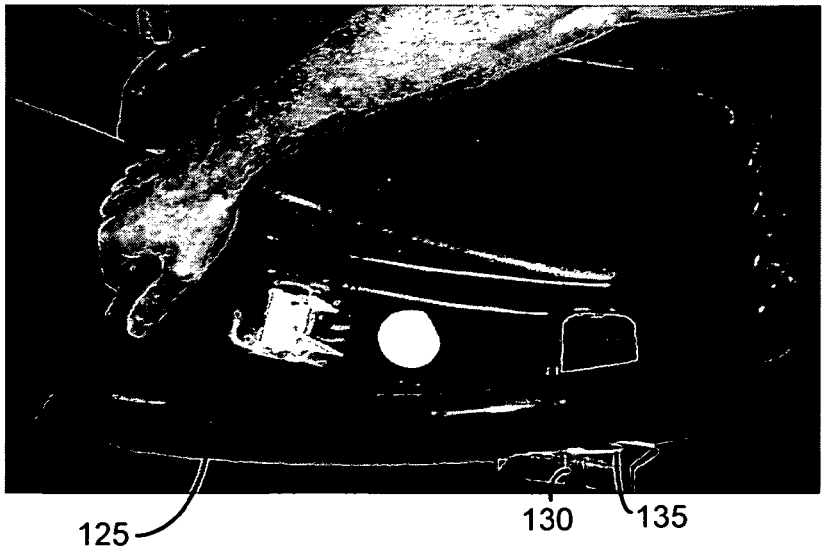
FIG. 4*e* is a schematic diagram of a top perspective view of the locking system of FIG. 4*a*, illustrating a force that can be applied to disengage the latch mechanism, according to an embodiment of the present invention.
Figure 4F:
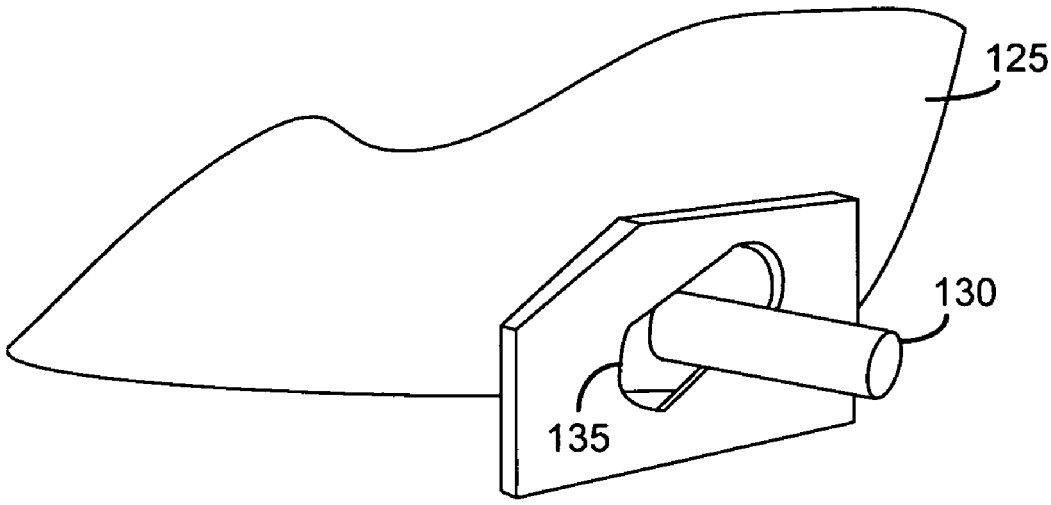
FIG. 4*f* is a schematic diagram of an exemplary bucket pivot mounted in a chassis slot, according to an embodiment of the present invention.
Figure 4G:
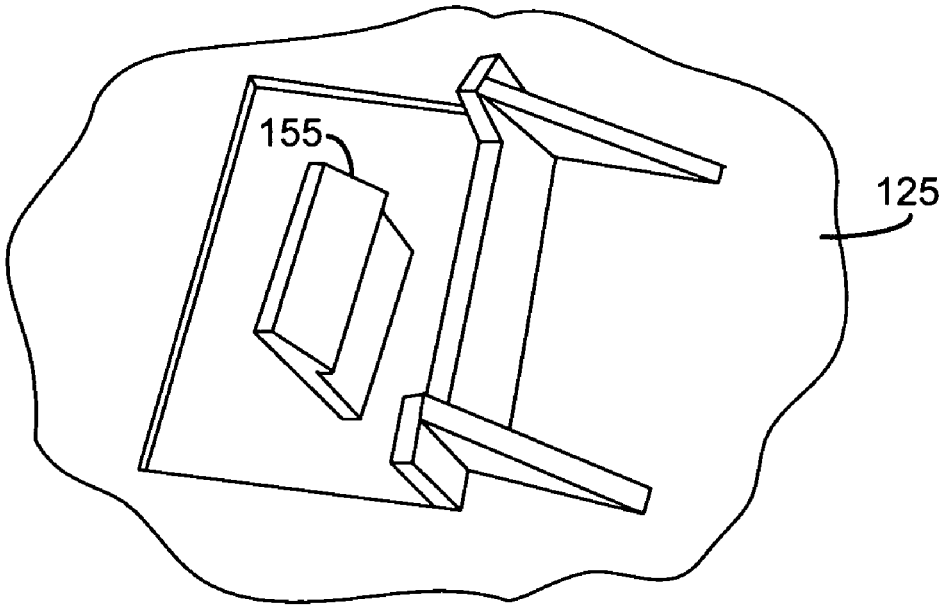
FIG. 4*g* is a schematic diagram of the latch mechanism of FIG. 4*b*, in a disengaged position.

To open bucket 125 starting from the engaged position, bucket 125 is moved in a direction going from latch mechanism 140 toward slot 135 (i.e., rearward), as shown in FIG. 4*e*, for example. This movement displaces bucket 125 rearward (with pivot pin 130 sliding up slot 135 as shown in FIG. 4*f*) such that latch 155 moves away from receiving portion 152, thus enabling bucket 125 to open. FIG. 4*g* shows this disengaged position.

Stated otherwise, by slightly displacing the bucket, the latch mechanism located at the front of wagon 100 is released, thus making it possible to freely raise the forward end of bucket 125 and pour out the contents of bucket 125.

Thus, as shown, for example, in FIGS. 4*a*-4*g*, even if a child were to lean on a rear part of bucket 125, bucket 125 would not open because latch 155 would be engaged with receiving portion 152 of latch receiver 150. It is only when a child pulls back on bucket 125 that latch mechanism 140 will release and thus allow bucket 125 to be rotated into an open or dumping position.

FIGS. 5*a*-6*b* illustrate an exemplary implementation of the present invention, showing separate plan views and side sectional views of a bucket 525 configured to be pivotably and slideably mounted on a chassis 510. As shown best in FIG. 5*b*, chassis 510 includes a latch 555 having a roughly triangular cross-section. This triangular shape enables the latch 555 to snap over and engage a latch receiver. In addition, the triangular shape can guide a bucket and its latch receiver as the bucket is lowered, especially if the pivot pin of the bucket has fallen to the lowest part of the slot. In that case, the triangular shape of the latch can still accept the latch receiver, by deflecting slightly and/or pushing the bucket pivot pin up the slot, to allow the bucket to fully lower and lock in place. When viewed in cross-section, a lower engagement plane of the latch 555 is angled with respect to a horizontal surface on which chassis 555 rests, as represented by angle 557. As an example, angle 557 could be 30 degrees. The inclination angle 558 of slot 535 (with respect to a horizontal surface on which chassis 510 rests) can be substantially the same as angle 557, e.g., 30 degrees.

Figure 5A:
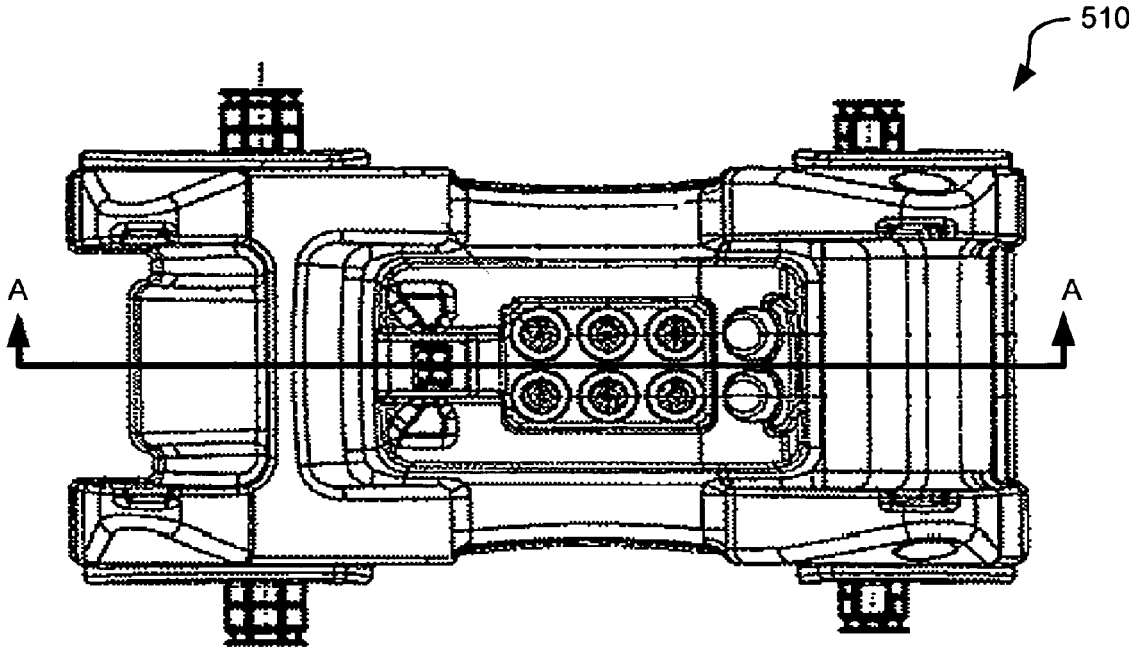
FIG. 5*a* is a schematic diagram of a top view of an exemplary chassis, according to an embodiment of the present invention.
Figure 5B:
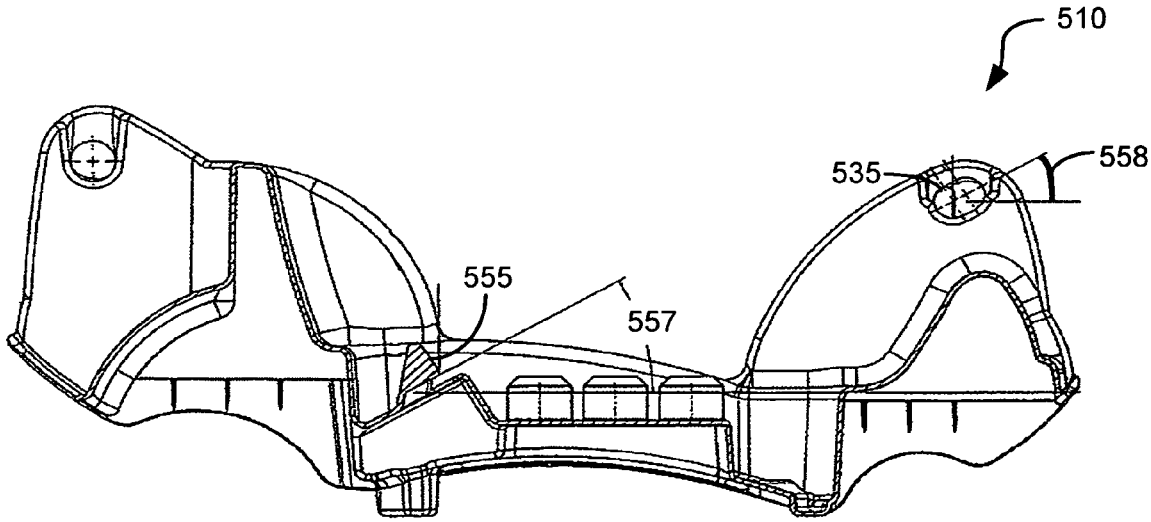
FIG. 5*b* is a schematic diagram of a cross-sectional view of the chassis of FIG. 5*a*, taken along section A-A of FIG. 5*a*.
Figure 6A:
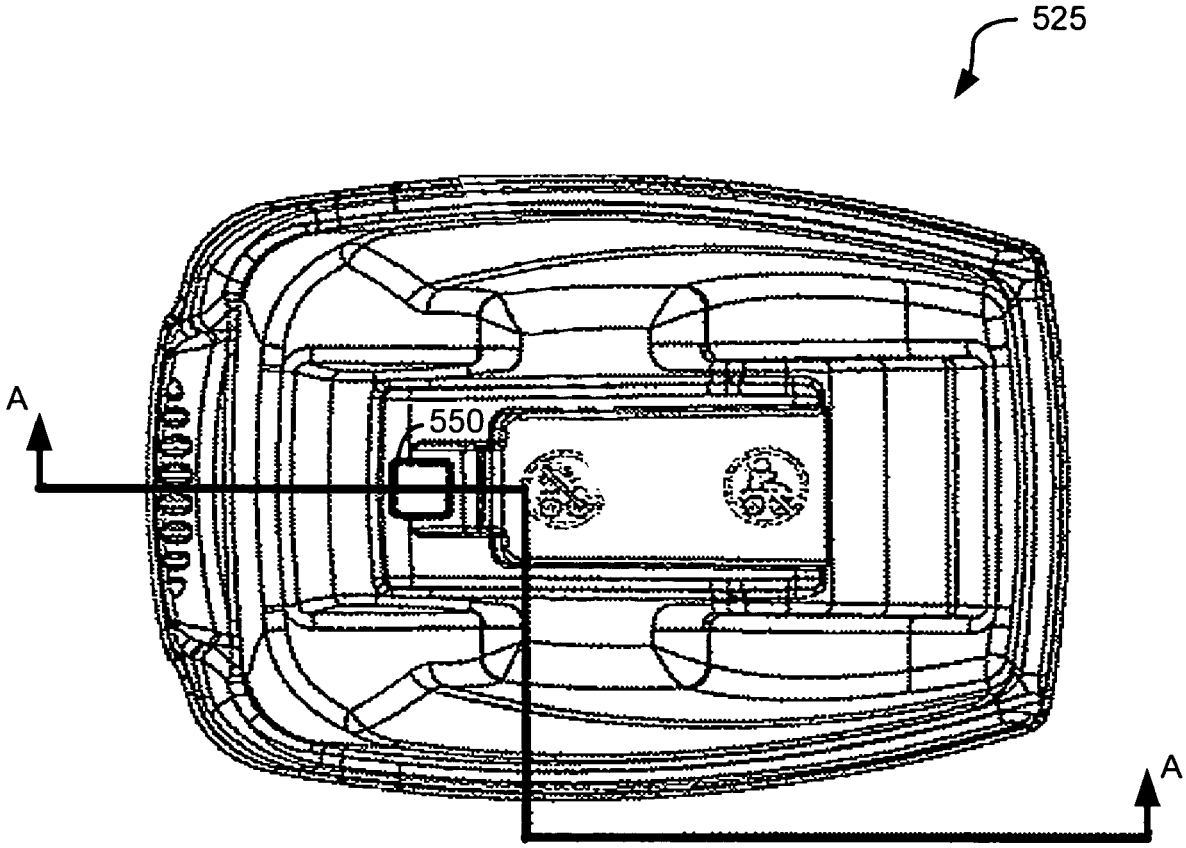
FIG. 6*a* is a schematic diagram of a top view of an exemplary bucket configured to be mounted on the chassis of FIGS. 5*a* and 5*b*, according to an embodiment of the present invention.
Figure 6B:
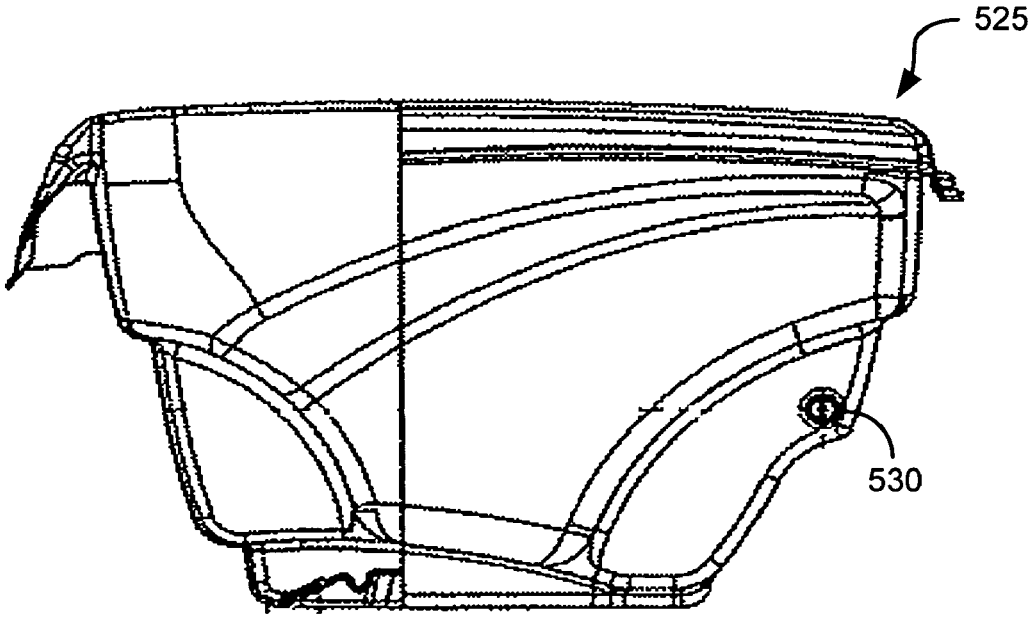
FIG. 6*b* is a schematic diagram of a cross-sectional view of the bucket of FIG. 6*a*, taken along section A-A of FIG. 6*a*.

As shown in FIGS. 6*a* and 6*b*, bucket 525 includes a latch receiver 550, which in this example is an opening that receives latch 555. As shown between FIGS. 5*b* and 6*b*, latch 555 is mounted on an inclined portion of chassis 510 that roughly matches the inclination of the corresponding portion of latch receiver 550 of bucket 525. As also shown in FIGS. 5*b* and 6*b*, chassis 510 includes a slot 535 configured to receive pivot pin 530 of bucket 525, and to enable pivot pin 530 to slide and pivot therein.

Figure 7:
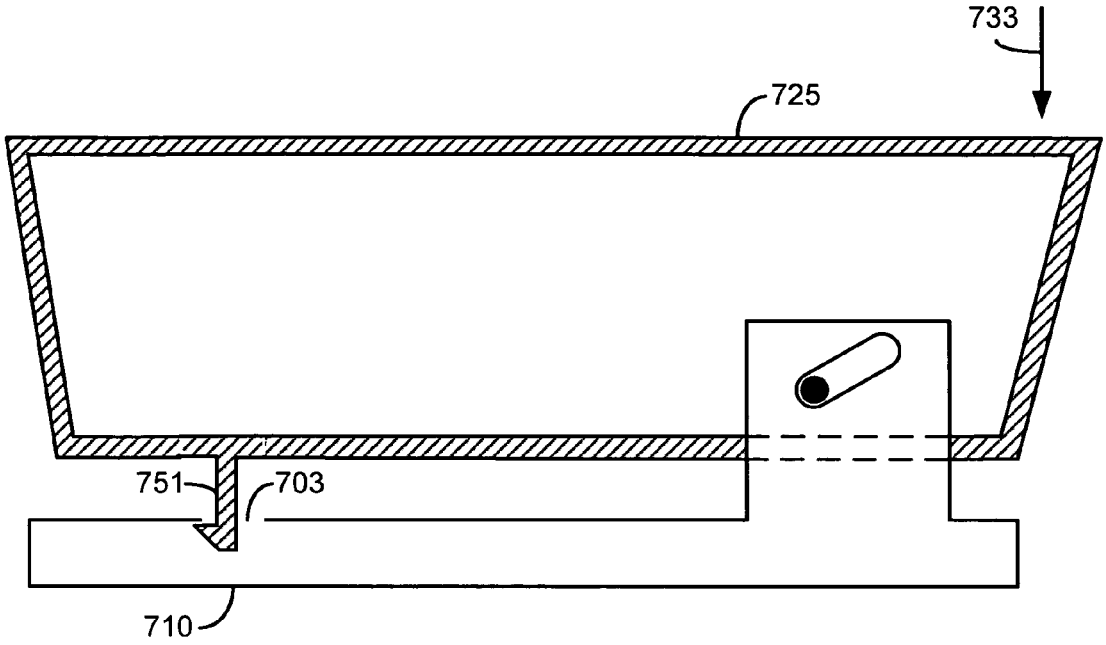
FIG. 7 is a schematic diagram of an alternative automatic bucket locking system having a latch on the bucket and a latch receiver on the chassis, shown in an engaged position, according to an alternative embodiment of the present invention.

In an alternative embodiment of the present invention, the latch mechanism comprises a latch on the bucket and a latch receiver on the chassis, as is shown in FIG. 7. In this embodiment, the latch 751 of the bucket 725 is engaged with the latch receiver 703 of the chassis 710 when the bucket 725 is in its most forward position. If a downward force (e.g., as represented by arrow 733) is applied to the rearward portion of the bucket 725, the latch 751 is further forced against latch receiver 703 and the bucket 725 is prevented from pivoting.

Figure 8:
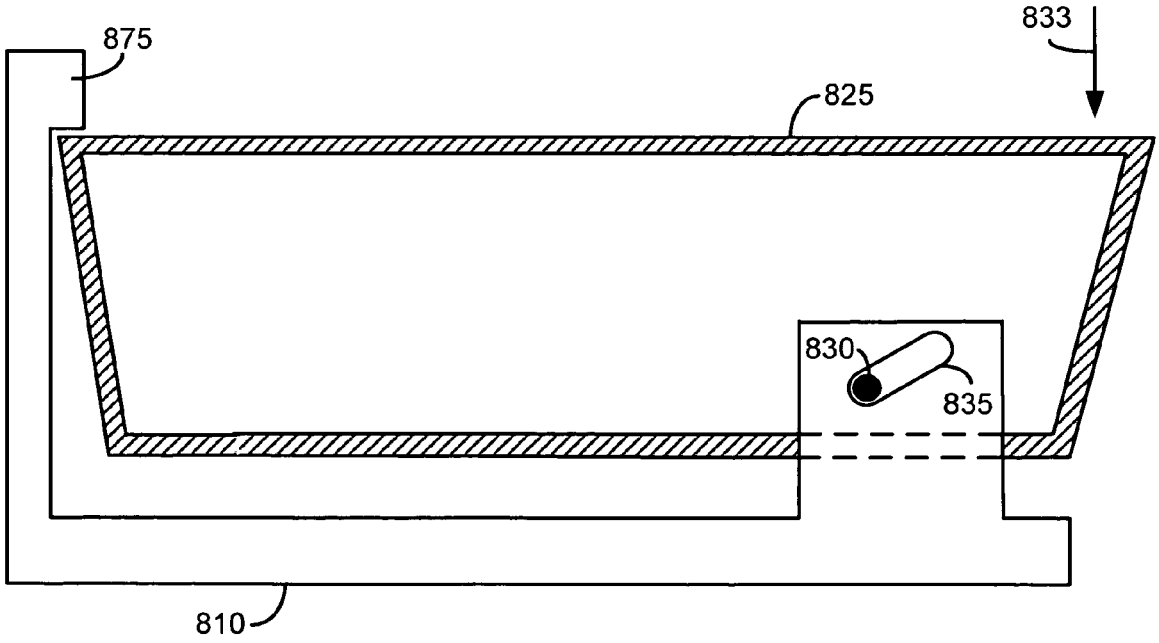
FIG. 8 is a schematic diagram of an alternative automatic bucket locking system having a projection on the chassis that engages the bucket, shown in an engaged position, according to an alternative embodiment of the present invention.

In another alternative embodiment of the present invention, the latch mechanism comprises the bucket itself and a cooperating projection on the chassis. For example, as shown in FIG. 8, a wagon bucket 825 could have no separate latch receiver and instead, could function itself as the latch and press against a projection 875 of the chassis 810. The forward top edge of the bucket 825 is engaged by projection 875 in an unloaded state, and presses against projection 875 when a downward force (e.g., as represented by arrow 833) is applied to the rearward end of the bucket 825. When the bucket 825 is moved in a rearward direction, the pivot pin 830 of the bucket 825 rises in the oblong slot 835 of the chassis 810, allowing the forward top edge of the bucket 825 to tilt downward, move rearward, and clear the projection. From this rearward position, the bucket can then pivot upward. Thus, notwithstanding the particular embodiments described above that use a latch receiver, the present invention should be considered broadly applicable to any chassis and bucket configuration that prevents the bucket from pivoting up when the bucket is in its most forward position.

Figure 9A:
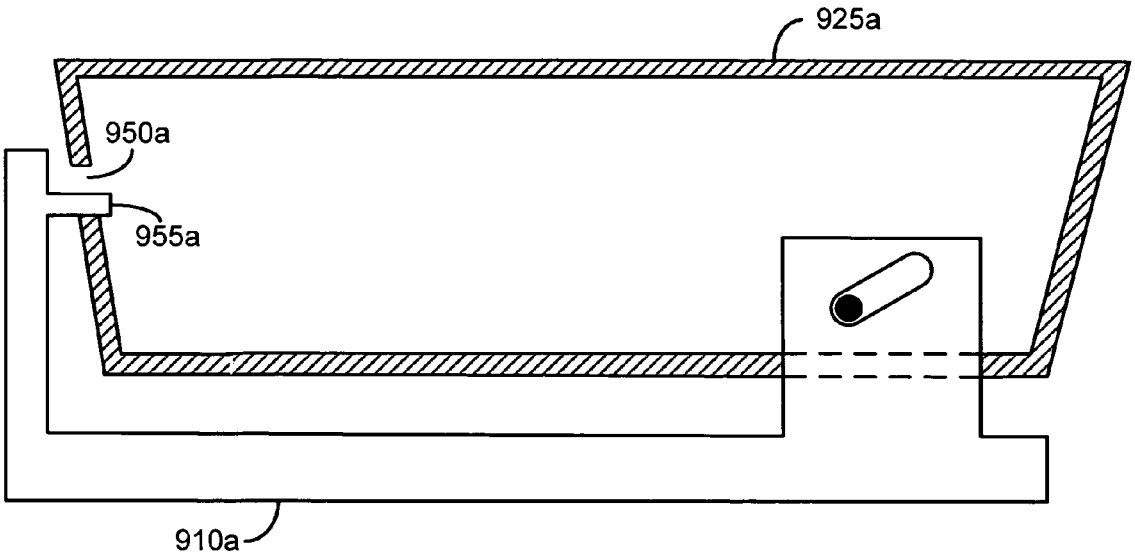
FIG. 9*a* is a schematic diagram of an alternative automatic bucket locking system having a horizontal latch on the chassis and a latch receiver on the forward portion of the bucket, shown in an engaged position, according to an alternative embodiment of the present invention.
Figure 9B:
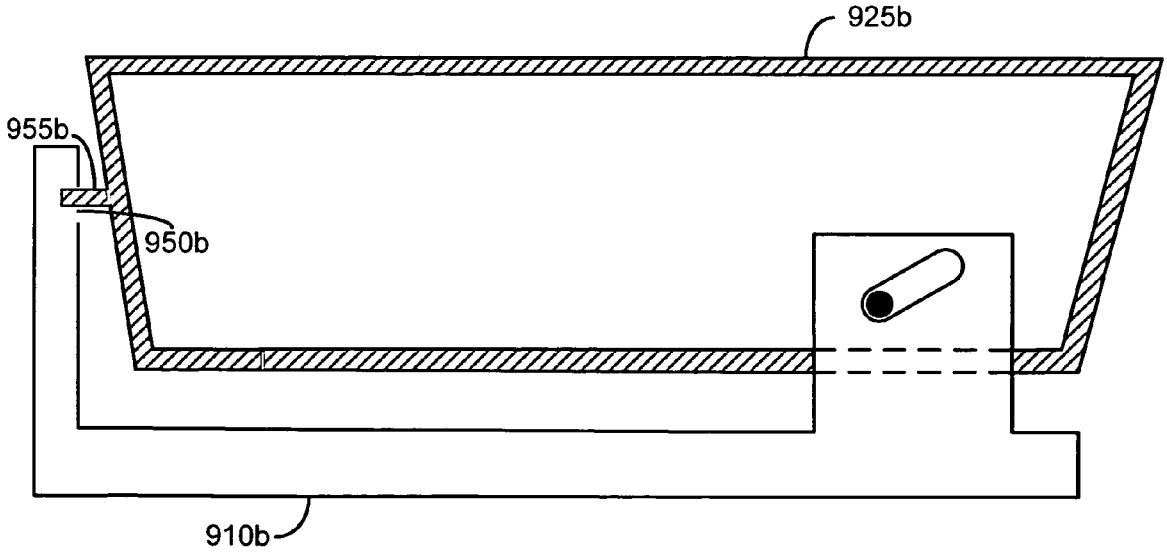
FIG. 9*b* is a schematic diagram of an alternative automatic bucket locking system having a horizontal latch on the forward portion of the bucket and a latch receiver on the chassis, shown in an engaged position, according to an alternative embodiment of the present invention.

In another alternative embodiment, the latch mechanism is provided at the forward portion of the bucket in a generally horizontal orientation, aligned generally with the direction in which the bucket slides in the slot of the chassis. FIGS. 9*a* and 9*b* illustrate this alternative embodiment. FIG. 9*a* illustrates a horizontal latch 955*a* of a chassis 910*a* cooperating with a latch receiver 950*a* of a bucket 925*a*. FIG. 9*b* illustrates a horizontal latch 955*b* of a bucket 925*b* cooperating with a latch receiver 950*b* of the chassis 910*b*.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A toy comprising:

a chassis having a forward portion and a rearward portion;

a pivoting member pivotably and slideably mounted on the rearward portion of the chassis, wherein the pivoting member pivots with respect to a pivot axis and slides in a direction radial to the pivot axis from a first pivot point at a first position to a second pivot point at a second position, wherein the second pivot point is disposed more rearward than the first pivot point, and wherein a line connecting the first pivot point with the second pivot point is inclined in a direction from the first pivot point to the second pivot point when the toy is viewed from a side elevation resting on a horizontal surface; and a latch mechanism that engages the chassis with the pivoting member in the first position and prevents the pivoting member from pivoting, and disengages the chassis from the pivoting member in the second position to allow the pivoting member to pivot, wherein the latch mechanism comprises:

one of a latch and a latch receiver disposed on the pivoting member a first horizontal distance apart from the pivot axis on a side of the pivot axis opposite to a rearward end of the pivoting member, and the other of the latch and the latch receiver disposed on the chassis a second horizontal distance apart from the first pivot point, wherein the first horizontal distance is greater than the second horizontal distance such that the one of the latch and the latch receiver engages the other of the latch and the latch receiver when the pivot axis is disposed at the first pivot point, wherein the other of the latch and the latch receiver is disposed on the chassis a third horizontal distance apart from the second pivot point, and wherein the third horizontal distance is greater than the first horizontal distance such that the one of the latch and the latch receiver disengages from the other of the latch and the latch receiver when the pivot axis is disposed at the second pivot point.

2. The toy of claim 1, wherein the chassis defines a slot extending longitudinally in the radial direction from the first pivot point to the second pivot point, wherein the pivoting member has a pivot pin rotatably and slideably mounted within the slot, wherein, in the first position, the pivot pin is disposed at a first end of the slot, and wherein, in the second position, the pivot pin is disposed at a second end of the slot opposite the first end.

3. The toy of claim 2 wherein the slot is linearly inclined in a direction from the first end to second end with respect to the horizontal surface.

4. The toy of claim 3, wherein the slot is inclined 30 degrees.

5. The toy of claim 2, wherein the chassis defines a second slot extending longitudinally in the radial direction from the first pivot point to the second pivot point, wherein the pivoting member has a second pivot pin rotatably and slideably mounted within the second slot, wherein, in the first position, the second pivot pin is disposed at a first end of the second slot, and wherein, in the second position, the second pivot pin is disposed at a second end of the second slot opposite the first end of the second slot.

6. The toy of claim 1, wherein the pivoting member is biased to rest in the first position in an unloaded state.

7. The toy of claim 1, wherein the latch mechanism comprises:

a latch protruding from the chassis; and a latch receiver on the pivoting member, wherein, when the pivoting member slides from the first position to the second position, the latch receiver disengages the latch, and wherein, when the pivoting member is in the first position and a force is applied to the pivoting member that forces the pivoting member toward the first position, the latch is further forced against the latch receiver.

8. The toy of claim 1, wherein the latch mechanism comprises:

a latch protruding from the pivoting member; and a latch receiver on the chassis, wherein, when the pivoting member slides from the first position to the second position, the latch receiver disengages the latch, and wherein, when the pivoting member is in the first position and a force is applied to the pivoting member that forces the pivoting member toward the first position, the latch is further forced against the latch receiver.

9. The toy of claim 1, wherein the latch mechanism comprises a projection protruding from the chassis, wherein the projection prevents the pivoting member from pivoting in the first position, wherein, when the pivoting member slides from the first position to the second position, the projection disengages the pivoting member, and wherein, when the pivoting member is in the first position and a force is applied to the pivoting member that forces the pivoting member toward the first position, the pivoting member is further forced against the projection.

10. The toy of claim 1, wherein the pivoting member is mounted on the chassis at a first end of the pivoting member, wherein the latch mechanism engages the pivoting member at a second end of the pivoting member opposite to the first end of the pivoting member, and wherein, with the pivoting member in a horizontal position, a downward force applied to the pivoting member between the first end of the pivoting member and the pivot axis locks the latch mechanism and prevents the pivoting member from pivoting.

11. The toy of claim 1, further comprising wheels rotatably mounted on the chassis.

12. The toy of claim 1, wherein the pivoting member comprises one of a bucket and a bed.

13. A dumping toy comprising:

a bucket having a forward end and a rearward end;

a pivot pin attached to a portion of the bucket closer to the rearward end than the forward end;

a chassis defining a slot, wherein the pivot pin is pivotably and slideably mounted within the slot, wherein the slot extends longitudinally in a direction radial to the axis of the pivot pin, wherein the slot has a first end closer to the forward end than the rearward end and a second end opposite to the first end, and wherein the slot is inclined in a direction from the first end to the second end when the toy is viewed from a side elevation resting on a horizontal surface; and a latch mechanism that engages the chassis with the bucket when the pivot pin is disposed at the first end of the slot and prevents the bucket from pivoting, and disengages the chassis from the bucket when the pivot pin is disposed at the second end of the slot and allows the bucket to pivot, the latch mechanism comprising:

one of a latch and a latch receiver disposed on the bucket a first horizontal distance apart from the pivot pin on a side of the pivot pin opposite to the rearward end, and the other of the latch and the latch receiver disposed on the chassis a second horizontal distance apart from the first end of the slot, wherein the first horizontal distance is greater than the second horizontal distance such that the one of the latch and the latch receiver engages the other of the latch and the latch receiver when the pivot pin is disposed at the first end of the slot, wherein the other of the latch and the latch receiver is disposed on the chassis a third horizontal distance apart from the second end of the slot, and wherein the third horizontal distance is greater than the first horizontal distance such that the one of the latch and the latch receiver disengages from the other of the latch and the latch receiver when the pivot pin is disposed at the second end of the slot.

14. The toy of claim 13, wherein, with the bucket in a horizontal position, a downward force applied to the bucket between the rearward end and the pivot axis locks the latch mechanism and prevents the bucket from pivoting.

15. The toy of claim 13, wherein the latch mechanism comprises:

a latch integral with and protruding from the chassis; and a latch receiver integral with the bucket, wherein the latch is disposed within the latch receiver when the pivot pin is disposed at the first end of the slot, and wherein the latch is spaced apart from the latch receiver when the pivot pin is disposed at the second end of the slot.

16. The toy of claim 15, wherein the latch has a triangular cross-section and is resiliently deformable, such that when the bucket, staffing from an unfolded position, pivots toward the latch with the pivot pin disposed at the first end of the slot, the latch contacts the latch receiver, deflects, and snaps over the latch receiver.

17. The toy of claim 15, wherein the latch has a triangular cross-section, such that when the bucket, starting from an unfolded position, pivots toward the latch with the pivot pin disposed at the first end of the slot, the latch contacts the latch receiver, pushes the latch receiver so that the pivot pin slides toward the second end of the slot and allows the latch to engage the latch receiver.

18. The toy of claim 13, further comprising wheels mounted on the chassis.

19. A dumping toy vehicle comprising:

a bucket having a forward end and a rearward end;

a pivot pin attached to the bucket closer to the rearward end than the forward end;

a chassis defining an oblong slot, wherein the pivot pin is pivotably and slideably mounted within the slot, wherein the slot extends longitudinally in a direction radial to the axis of the pivot pin, wherein the slot has a first end closer to the forward end than the rearward end and a second end opposite to the first end, and wherein the slot is inclined in a direction from the first end to the second end with respect to a horizontal surface on which the toy rests;

a latch mechanism that engages the chassis with the bucket when the pivot pin is disposed at the first end of the slot and prevents the bucket from pivoting, and disengages the chassis from the bucket when the pivot pin is disposed at the second end of the slot and allows the bucket to pivot, the latch mechanism comprising:

one of a latch and a latch receiver disposed on the bucket a first horizontal distance apart from the pivot pin on a side of the pivot pin opposite to the rearward end, and the other of the latch and the latch receiver disposed on the chassis a second horizontal distance apart from the first end of the slot, wherein the first horizontal distance is greater than the second horizontal distance such that the one of the latch and the latch receiver engages the other of the latch and the latch receiver when the pivot pin is disposed at the first end of the slot, wherein the other of the latch and the latch receiver is disposed on the chassis a third horizontal distance apart from the second end of the slot, and wherein the third horizontal distance is greater than the first horizontal distance such that the one of the latch and the latch receiver disengages from the other of the latch and the latch receiver when the pivot pin is disposed at the second end of the slot; and wheels rotatably mounted on the chassis, wherein the wheels rest on the horizontal surface.

* * * * *